United States Patent [19]

Tachibana et al.

[11] Patent Number: 4,691,663

[45] Date of Patent: Sep. 8, 1987

[54] DEVELOPING DEVICE

[75] Inventors: Natsuki Tachibana, Kamakura; Issey Ichihara, Chiba, both of Japan

[73] Assignee: Kabushiki Kaisha Toshiba, Kawasaki, Japan

[21] Appl. No.: 894,747

[22] Filed: Aug. 11, 1986

Related U.S. Application Data

[63] Continuation of Ser. No. 758,679, Jul. 25, 1985, abandoned.

[30] Foreign Application Priority Data

Jul. 31, 1984 [JP] Japan ..... 59-160516

[51] Int. Cl.[4] ..... G03G 15/09

[52] U.S. Cl. ..... 118/658

[58] Field of Search ..... 118/658

[56] References Cited

U.S. PATENT DOCUMENTS 3,970,042 10/1986 Rees ..... 118/637

4,308,821 1/1982 Matsumoto et al. ..... 118/645

4,351,604 9/1982 Karasawa et al. .

4,392,735 7/1983 Oka .

4,545,325 10/1985 Komatsu et al. ..... 118/645

*Primary Examiner*—Bernard D. Pianalto

*Attorney, Agent, or Firm*—Cushman, Darby & Cushman

[57] ABSTRACT

A developing device is opposed to a photosensitive drum which is rotated in one direction, and develops a latent image formed on the photosensitive drum. The developing device is provided with a first developing roller which is rotatably arranged to oppose the photosensitive drum and holds a first developing agent, and a second developing roller which is rotatably arranged to oppose the photosensitive drum, located adjacent to the first developing roller along one direction and holds a second developing agent. The first developing roller is rotated in one direction, to supply the first developing agent onto the photosensitive drum, and the second developing roller is rotated in a direction opposite to the direction to supply the second developing agent onto the photosensitive drum.

11 Claims, 8 Drawing Figures

DEVELOPING DEVICE

This is a continuation of application Ser. No. 758,679, filed July 25, 1985, which was abandoned upon the filing hereof.

BACKGROUND OF THE INVENTION

The present invention relates to a developing device for developing an electrostatic latent image with a two-component developing agent and, more particularly, to a developing device which has two developing rollers and which can be suitably used in a two-color copying machine.

In a conventional two-color copying machine of this type, a plurality of cartridges for different colors are prepared. Each cartridge integrally has a developing device and a photosensitive drum. An operator selectively uses a cartridge of a desired color every time copying is performed. Cartridge changing is time-consuming and cumbersome, resulting in inconvenience.

The present inventors have developed a two-color developing device wherein a latent image on a photosensitive drum is developed by selectively operating first and second developing rollers upon depression of a button.

Demand has also arisen for a compact high-speed copying machine. Along with this, a compact photosensitive drum having a diameter of 80 mm or less has been devised.

A conventional two-color developing device uses two developing rollers and requires a large space. However, in order to guarantee a developing time at a high copying speed (30 sheets/minute), the diameter of the developing rollers cannotd be decreased. As a result, a compact high-speed two-color copying machine cannot be obtained.

SUMMARY OF THE INVENTION

The present invention has been made in consideration of the above situation, and has as its object to provide a developing device wherein two-color development can be performed with a compact construction at high speed.

In order to achieve the above object of the present invention, one of the first and second developing rollers is rotated together with an image carrier in an "against" mode and the other developing roller is rotated in a direction opposite to that of the image carrier in a "with" mode. The developing roller which is not frequently used comprises a small-diameter developing roller used in the "against" mode. Although the processing speed is decreased, the developing device is made compact as a whole. However, the developing roller which is frequently used comprises a large-diameter developing roller used in the "with" mode. With this large-diameter developing roller, the developing time can be sufficiently guaranteed and the processing speed is increased.

BRIEF DESCRIPTION OF THE DRAWINGS

FIGS. 1 to 7 show an embodiment of the present invention, in which:

FIG. 1 is a side sectional view schematically showing the main part of a copying machine which employs a developing device according to the embodiment of the present invention, FIG. 2 is a sectional view schematically showing a developing state of the developing apparatus in the "against" mode, FIG. 3 is a sectional view schematically showing a development agent removal state of the developing device in the "against" mode, FIG. 4 is a sectional view schematically showing a developing state of the development device in the "with" mode, FIG. 5 is a sectional view schematically showing a developing agent removal state of the developing device in the "with" mode, FIG. 6 is a sectional view showing a developing state of a first developing unit, and FIG. 7 is a sectional view showing a developing state of a second developing unit.

DETAILED DESCRIPTION OF THE PREFERRED EMBODIMENTS

A copying machine which employs a developing device according to an embodiment of the present invention will be described in detail with reference to FIGS. 1 to 7.

Figure 1:
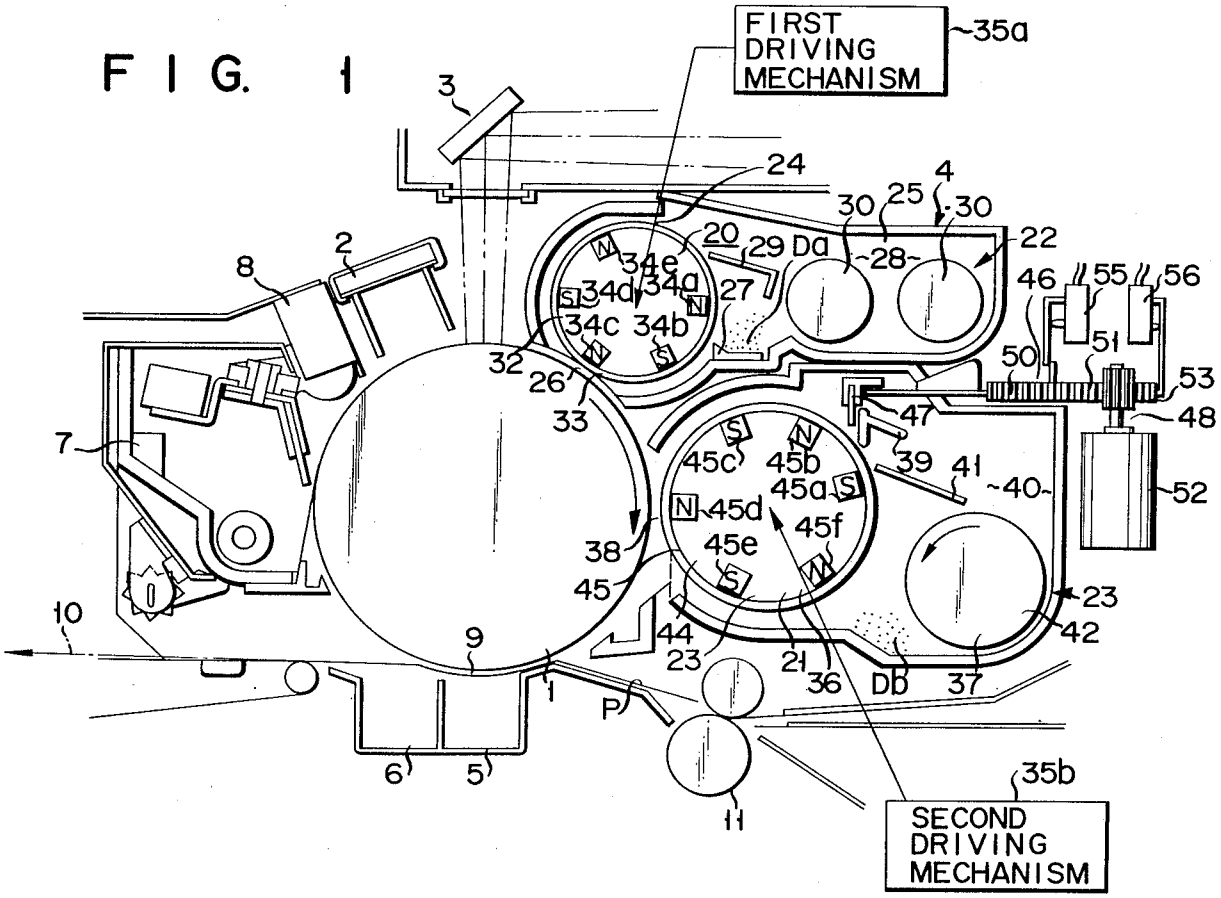

FIG. 1 shows the main part of a two-color copying machine incorporating the developing device of this embodiment. Reference numeral 1 denotes a photosensitive drum as an image carrier which is disposed substantially at the center of the copying machine housing and which can be rotated clockwise. The photosensitive drum 1 has a diameter of 78 mm. A charging device 2, an exposure device 3, a two-color developing device 4 (to be described later), a transfer device 5, a separating device 6, a cleaning device 7 and an afterimage erasing device 8 are sequentially arranged around the photosensitive drum 1 along the rotational direction thereof.

A sheet P automatically fed from a paper feed cassette (not shown) or a manually fed sheet P is guided by a paper convey path 10 to an exhaust tray (not shown) through an image transfer section 9 formed between the drum 1 and the device 5. The path 10 is formed at the lower portion of the housing.

A pair of aligning rollers 11 are located at an upstream side of the section 9 in the path 10, and a fixing device (not shown) and a pair of exhaust rollers are located at the downstream side thereof.

The drum 1 is rotated by a drive mechanism (not shown) in synchronism with a document table (not shown) in the direction of the arrow (clockwise in FIG. 1). The drum 1 is uniformly charged by the device 2, and an image of a document placed on the document table is exposed by the device 3 and is formed on the drum 1. A latent image corresponding to the document image is thus formed on the drum 1. The latent image on the drum 1 is developed by the device 4, and a visible image opposes the device 5. On the other hand, the automatically or manually fed sheet P is fed by the rollers 11 to the section 9 through the path 10. The visible image formed on the drum 1 is transferred by the device 5 onto the sheet P. The image transferred sheet is separated by an AC corona charge of the device 6 from the drum 1. The separated sheet is fed to the fixing device through the path 10. The visible image is melted and fixed on the sheet P. The resultant sheet is exhausted by the pair of exhaust rollers onto the exhaust tray.

On the other hand, residual toner left on the drum 1 after the visible image is transferred onto the sheet P is cleaned by the device 7. After cleaning, the surface potential of the drum 1 is lowered by the device 8 below a predetermined level. The copying machine is thus ready for the next copying cycle.

The developing device 4 has a first developing roller 20 as a first developing member and a second developing roller 21 as a second developing member. The developing rollers 20 and 21 are selectively driven to develop the latent image with a black or red toner.

The developing device 4 is divided into a first developing unit 22 including the roller 20 and a second developing unit 23 including the roller 21. The upper unit 22 uses a red developing agent Da which is not frequently used. The lower unit 23 uses a black developing agent Db which is frequently used. The developing agents Da and Db respectively comprise two-component developing agents each consisting of a toner and a carrier.

Figure 2:
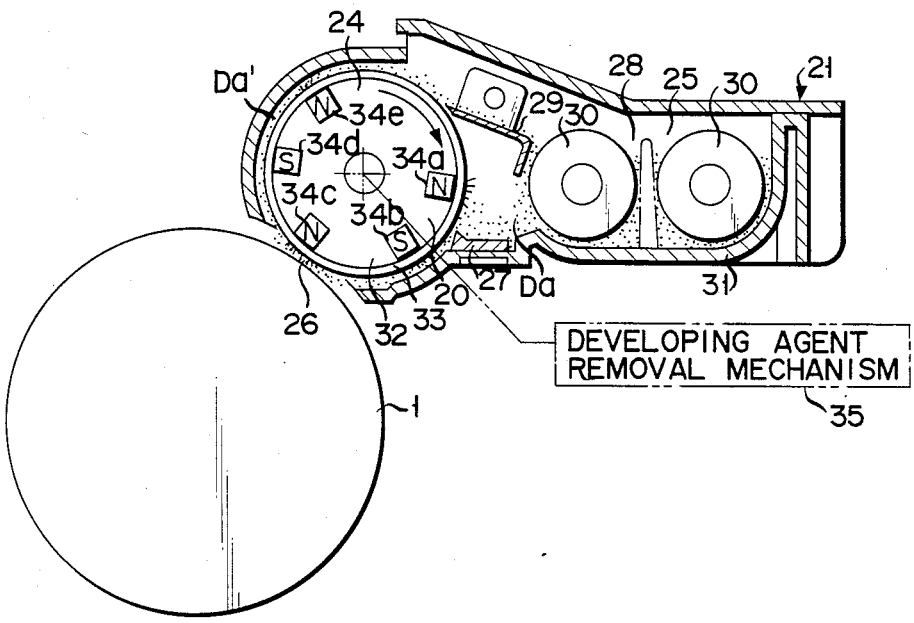
Figure 3:
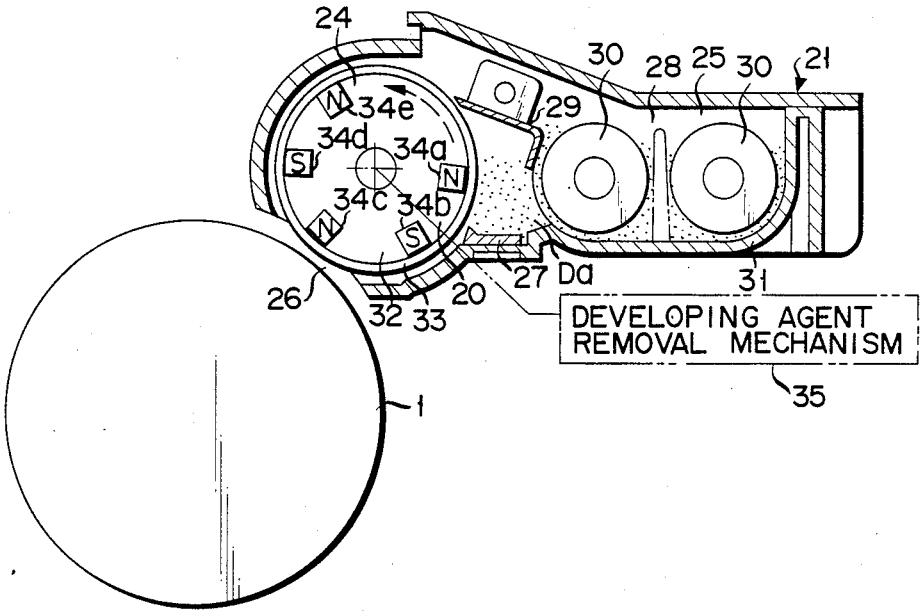

As shown in FIGS. 2 and 3, the unit 22 using the agent Da is mainly divided into a first developing mechanism 24 and a first development agent stirring mechanism 25. The unit 22 comprises: the roller 20, a first doctor blade 27 arranged at a sliding contact portion between a developing agent magnetic brush Da' formed on the surface of the roller 20 and the drum 1, i.e., at the upstream of a developing position 26, so as to adjust the thickness of the brush Da'; a scraper 29 arranged at the downstream of the position 26 to scrap the brush Da' on the surface of the roller 20 and to guide the scraped developing agent to a developing agent hopper 28; stirring members 30 arranged in the hopper 28; and a casing 31 for housing the above-mentioned members of the unit 22.

The roller 20 comprises a first magnetic roll 32 and a first sleeve 33 fitted around the roll 32 to be rotatable clockwise.

The roll 32 has five magnetic poles 34*a* to 34*e*. The poles 34*a*, 34*c* and 34*e* are north poles, and the poles 34*b* and 34*d* are south poles, respectively. The poles 34*a* to 34*e* are arranged at equal angular intervals of about 50 to 70 degrees. The pole 34*c* opposing the position 26 has a magnetic force of 700 to 1,000 Gauss, and the remaining poles 34*a*, 34*b*, 34*d* and 34*e* have a magnetic force of 300 to 600 Gauss.

In the unit 22, the sleeve 33 is rotated clockwise by a first driving mechanism 35*a*, i.e., in the so-called "against" mode. The brush Da' held on the surface of the sleeve 33 is rotated in a direction opposite to that of the drum 1 and is in sliding contact with the drum 1, so that the latent image formed on the drum 1 is developed. In this manner, since the first rotational sleeve 33 is rotated in the "against" mode, the diameter of the roller 20 can be decreased, and a space from the position 26 to the section 9 can be minimized. As a result, a compact copying machine can be obtained.

Since the diameter of the drum 1 is 78 mm in this embodiment, the distance between the position 26 and the section 9 is only about 122 mm along the drum circumference. In order to increase the distance between the position 26 and the section 9, the sizes of the devices 2 and 7 must be further decreased but there are limits.

Based on the above assumptions, the present inventors found that a compact copying machine could be obtained when the diameter of the roller 20 was 40 mm or less. They also found that the heights of the units 22 and 23 were required to be 120 mm or less when the drum diameter was 78 mm. In other words, the units 22 and 23 must have a low profile. For this purpose, a low-profile "against" mode developing device, available at low cost and having a small number of poles, is normally used. In this particular, the unit 22 as the upper developing unit has an opening facing downward, so that the agent Da leaks when the unit 22 is operated in the "with" mode wherein the agent Da flows downward. It is advantageous that the unit 22 be operated in the "against" mode.

In the unit 22, the brush Da' on the sleeve 33 will not be removed by a developing agent removal mechanism 35. The mechanism 35 comprises the first drive mechanism 35*a*, as shown in FIG. 3. The mechanism 35*a* serving as the mechanism 35 causes the sleeve 33 to rotate counterclockwise (in a direction opposite to that during development). In this manner, the mechanism 35 is simple and low cost.

The sleeve 33 is rotated in the reverse direction at the end of copying, so that the agent Da is fed in the reverse direction. The agent Da on the sleeve 33 is therefore stored between the blade 27 and the scraper 29, as shown in FIG. 3.

When the pole unit comprises 5 poles, the developing agent Da can be effectively fed or stopped as far as the first pole (feed pole) 34*a* is separated from the fifth pole (feed pole) 34*e*. Therefore, the number of poles is preferably 5 or less.

A thin elastic member (not shown) of Myler (tradename) is mounted on the scraper 29 such that its distal end is in contact with the sleeve 33. The feed prevention effect for the agent Da is improved by the thin elastic member.

Reverse rotation of the sleeve 33, that is, removal of the brush Da' is performed in accidental stoppage of the copying machine as well as upon completion of development (i.e., the end of copying). Assume that the power switch is accidentally turned off or the sheet is jammed. When the power switch is turned on again or the sheet is removed, the optical system of the device 3 restores the initial state. At the same time, the sleeve 33 is rotated in the reverse direction. In this manner, when the "copy enable" state, i.e., the ready state is set, the agent Da is not present at least near the position 26 on the sleeve 33.

When the sleeve 33 comprises a compact sleeve which has a diameter of about 40 mm or less, the rotational direction of the sleeve 33 is reversed as described above. For this purpose, however, the roll 32 can be rotated by a drive source such as a solenoid so that the pole 34*a* opposes the blade 27 of a nonmagnetic member.

Figure 4:
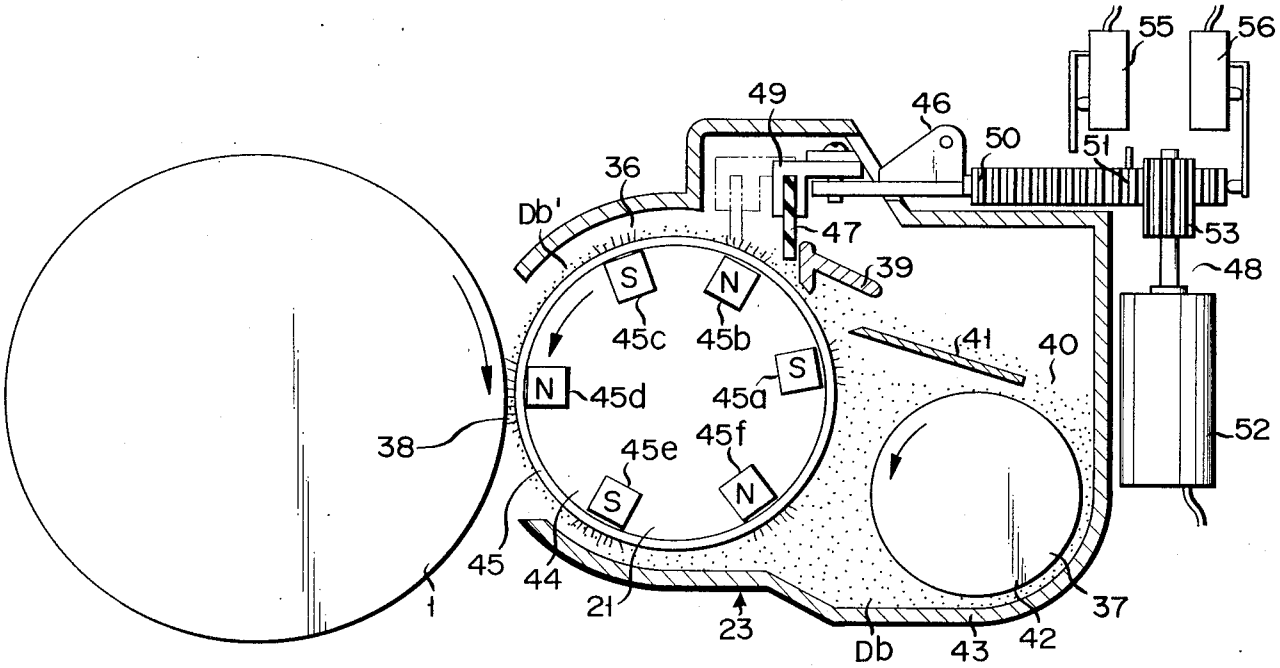
Figure 5:
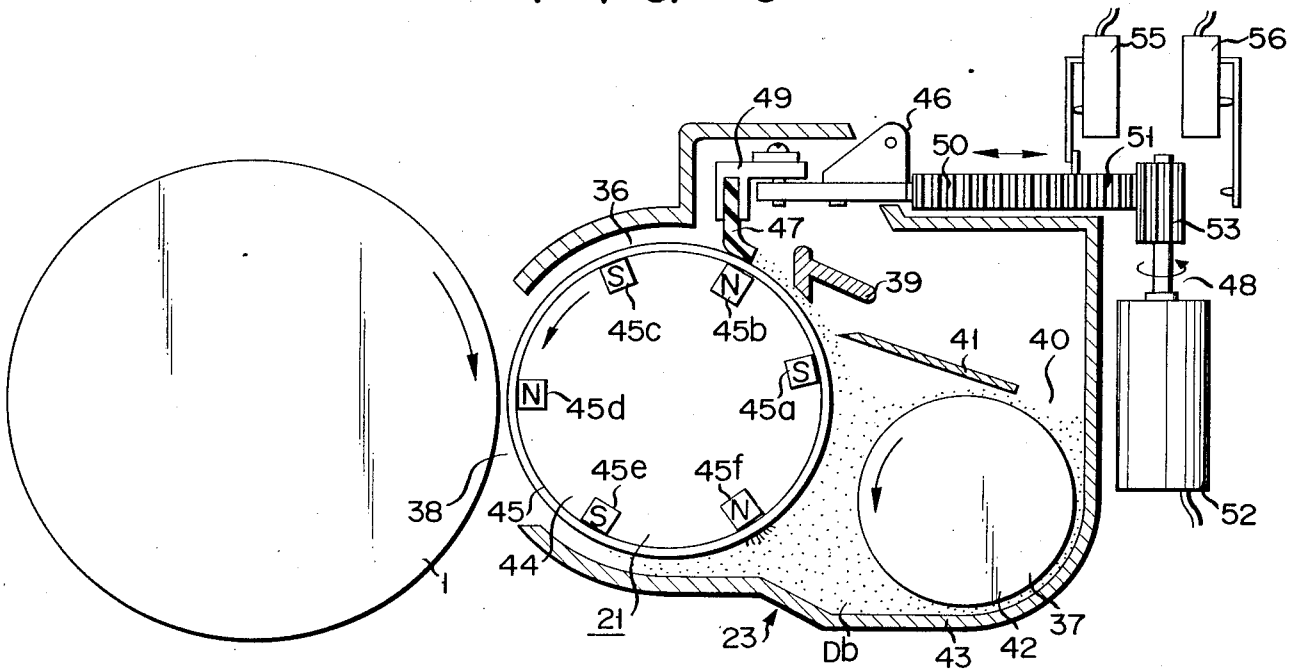

As shown in FIGS. 4 and 5, the unit 23 using the black developing agent Db is mainly divided into a second developing mechanism 36 and a second developing agent stirring mechanism 37. The unit 23 comprises: the second developing roller 21, a second doctor blade 39 arranged at a sliding contact portion between a developing agent magnetic brush Db' formed on the surface of the roller 21 and the drum 1, i.e., at the upstream of a developing position 38 so as to adjust the thickness of the brush Db'; a guide 41 for guiding the agent Db removed by the blade 39 to a developing agent hopper 40; a developing agent stirring member 42 arranged in the hopper 40; and a casing 43 for housing the above-mentioned components of the unit 23.

The roller 21 comprises a second magnetic roll 44 and a second rotational sleeve 45 fitted around the roll 44 and rotated counterclockwise.

In the unit 23, the roller 21 has a larger diameter than that of the roller 20 to achieve high-speed development. At the same time, the sleeve 45 is rotated by a second driving mechanism 35*b* counterclockwise, i.e., in the "with" mode. The brush Db' held on the surface of the roller 20 is rotated to follow the rotational direction of the drum 1 and is brought into sliding contact with the latent image on the drum. A long development time can be guaranteed, and at the same time, a latent image of top quality can be developed.

The roll 44 has six magnetic poles 45*a* to 45*f*, one more than for the roller 20. The poles 45*b*, 45*d* and 45*f* are north poles, and the poles 45*a*, 45*c* and 45*e* are south poles. The poles 45*a* to 45*f* are arranged at equal angular intervals of about 50 to 60 degree. The pole 45*d* opposing the position 38 has a magnetic force of 800 to 1,000 Gauss, and the poles 45*a*, 45*b*, 45*c*, 45*e* and 45*f* have a magnetic force of 400 to 600 Gauss.

In the unit 23, the brush Db' formed on the sleeve 45 is removed by a developing agent removal mechanism 46. As shown in FIGS. 4 and 5, the mechanism 46 comprises a blade 47 of an elastic member such as urethane rubber and a blade moving mechanism 48 for horizontally moving the blade 47. The mechanism 46 causes the blade 47 to abut against the surface of the sleeve 45 to prevent the agent Db from being fed to the position 38.

The mechanism 48 is arranged such that a rack 51 mounted on a slider 50 integral with a blade holder 49 is meshed with a pinion 53 driven by a motor 52.

When the motor 52 is rotated in the forward or reverse direction, the slider 50 is moved forward or backward. The blade 47 is brought into contact with the surface of the sleeve 45, as shown in FIG. 5, and separated therefrom, as shown in FIG. 4.

The contact position of the blade 47 with respect to the sleeve 45 is located between the preset position of the blade 39 and the preset position of the pole 45*b* for the following reason. In order to effectively remove the brush Db', the best contact position of the blade 47 is a position opposite to the pole 45*b*. However, when the distance between the blades 47 and 39 is increased, the amount of agent Db stored therebetween is increased. For this reason, the agent Db stored between the blades 47 and 39 is scraped upon one revolution of the drum 1 during the next copying operation, thereby contaminating the inside of the housing. Therefore, the optimal contact position of the blade 47 is a position subjected to effective scraping, i.e., the position between the blade 39 and the pole 45*b*.

Reference numerals 55 and 56 denote position sensors for detecting forward and backward positions of the slider 50, respectively. The motor 52 is stopped in response to detection signals from the position detectors 55 and 56.

The blade 47 is brought into rolling contact with the sleeve 45 immediately before the sleeve 45 is stopped. Thereafter, the sleeve 45 is rotated by half of one revolution. The blade 47 is separated from the sleeve 45, as shown in FIG. 4. Therefore, the agent Db is removed from at least the developing position of the sleeve 45.

Contact operation of the blade 47, i.e., the operation for removing the brush Db is performed in accidental stoppage of the copying machine as well as upon completion of development (the end of copying) in the same manner as in the unit 22. Assume that the power switch is accidentally turned off or paper jam occurs. When the copying machine is powered again or the sheet is removed, the optical system of the device 3 restores the initial state. At the same time, the blade 47 is brought into contact with the sleeve 45. In the copy enable state, i.e., the ready state, the agent Db is not present near the position 38 on the sleeve 45.

Figure 6:
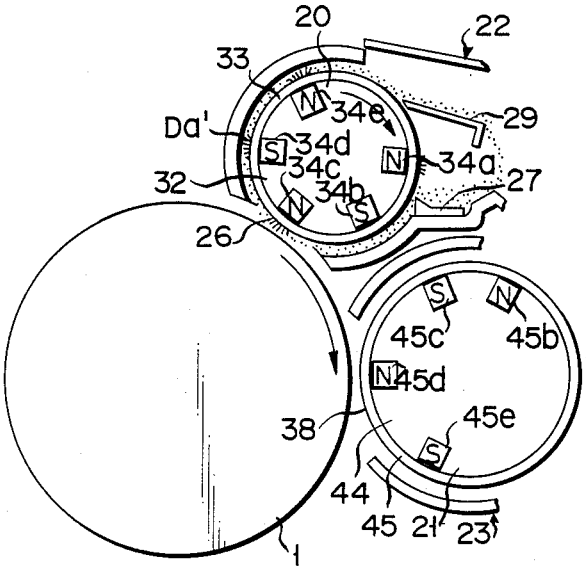

The units 22 and 23 are selectively operated in response to a control signal from a color designation unit (not shown). When red is designated, only the brush Da' is formed on the sleeve 33 of the unit 22, as shown in FIG. 6. However, when the black is designated, only the brush Db' is formed on the sleeve 45 of the unit 23.

When a control signal is generated to operate the unit 22, the sleeve 33 of the roller 20 is rotated clockwise, as shown in FIG. 6, so that the brush Da' is formed on the surface of the sleeve 33. The latent image formed on the drum 1 in advance is developed with the red developing agent Da.

When development is completed, the mechanism 35 is operated. More specifically, the sleeve 33 is rotated in the reverse direction, and the agent Da is removed from at least the position 26. The copying machine is then ready for the next copying cycle.

In this case, the brush Db' is not formed on the sleeve 45 of the unit 23. No failure occurs when either of the colors of the unit 22 and 23 is specified next.

Figure 7:
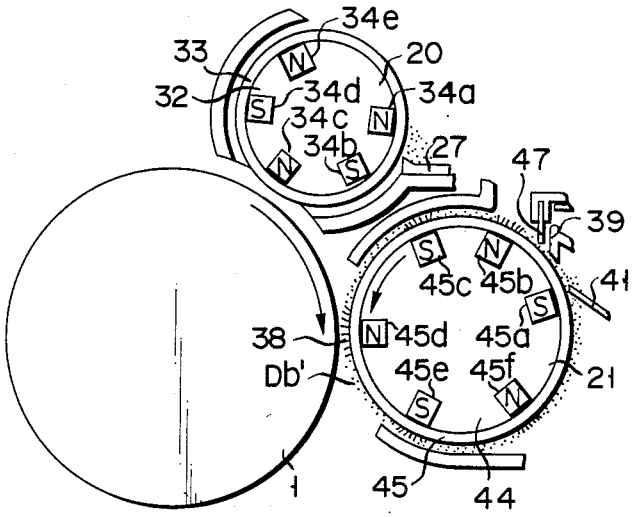

When a control signal is generated to designate the unit 23, the sleeve 45 of the roller 21 is rotated counterclockwise, as shown in FIG. 7. The brush Db' is formed on the surface of the sleeve 45. The latent image formed on the drum 1 rotated at a higher speed than that during development by the unit 22 is developed with the black developing agent Db, thereby preparing for high-speed copying.

When development of the latent image is completed, the mechanism 46 is operated. More specifically, the blade 47 is brought into tight contact with the surface of the sleeve 45 to remove the agent Db from at least the position 38 of the sleeve 45. The copying machine is thus ready for the next copying cycle.

In this case, the brush Da' is not formed on the sleeve 33 of the unit 22. No failure occurs when either of the colors of the units 22 and 23 is specified next.

The processing speed is increased in the black copy mode, and is decreased in the red copy mode, thereby improving image quality of the black copy operation which is frequently performed. According to this embodiment, when A4 size sheets are fed such that the long sides thereof are first fed, the peripheral speed of the drum 1 is 223 mm/s, i.e., 35 sheets/minute during development by the unit 23. However, when red copying is performed and A4 size sheets are fed such that the long sides thereof are first fed, the peripheral speed of the drum 1 is 136 mm/s, i.e., 25 sheets/minute during development by the unit 22. The diameter (38 mm) of the roller 20 is smaller than that (50 mm) of the roller 21. In this manner, when a developing time is sufficiently guaranteed, high-quality color (red) image can be obtained. Furthermore, black images can be copied at a high speed.

In the above embodiment, the operation of the mechanism 46 for bringing the blade 47 into contact with or separating it from the sleeve 45 is performed such that the driving force of the motor 52 is transmitted through a power transmission system including the rack 51 and the pinion 53. However, the power transmission system and associated components are not limited to the above arrangement, but can be extended to a system for transmitting movement of a solenoid through a link mechanism or the like.

In the above embodiment, the unit 22 is used as a red developing unit, and the unit 23 is used as a black developing unit. However, colors are not limited to red and black, but can be extended to other colors.

In the above embodiment, the unit 22 is operated in the "against" mode wherein the brush Da' is brought into slidable contact with the latent image in a direction opposite to the flow of the image of the drum 1. The unit 23 is operated in the "with" mode wherein the brush Da' held on the surface of the unit 23 is brought into slidable contact with the latent image so as to follow the latent image. However, the present invention is not limited to the arrangement described above. The units 22 and 23 may be operated in the "with" mode.

Figure 8:
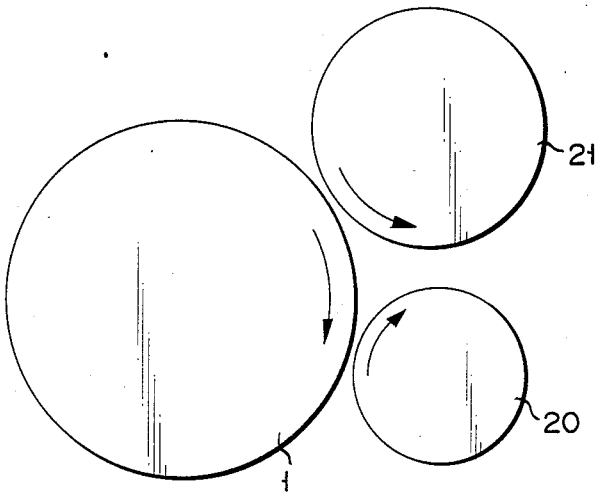
FIG. 8 is a side view schematically showing a developing apparatus according to another embodiment of the present invention.

As another embodiment shown in FIG. 8, a "with" mode developing roller 21 is arranged at the upstream side along the rotational direction of the drum 1. An "against" mode developing roller 20 may be located at the downstream side of the roller 21. It is essential that one of the rollers which is frequently used be operated in the "with" mode, and the development of a color frequently used be performed at high speed.

Various changes and modifications may be made within the spirit and scope of the invention.

According to the present invention as described above, one of the first and second developing members is rotated in the same direction as that of the image carrier. While one developing member performs development, the developing agent is removed from at least the developing position on the surface of the other developing member. A developing unit can be provided wherein a high-quality developing operation without a mixture of colors can be simply performed and high-speed development can be performed with a simple and inexpensive structure.

What is claimed is:

1. A developing device, opposing an image carrier which is rotated along one direction, for developing a latent image formed on said image carrier, comprising:

a first developing member, rotatably arranged to oppose said image carrier, for holding a first developing agent thereon, said first developing member comprising a first developing roller having a predetermined diameter;

a second developing member, rotatably arranged to oppose said image carrier and located adjacent to said first developing member along said one direction, for holding a second developing agent thereon, said second developing member comprising a second developing roller having a diameter larger than the predetermined diameter of the first developing roller, said first developing member being located at an upstream side of said second developing member with respect to said one direction;

first driving means for causing said first developing member to rotate in said one direction to supply the first developing agent onto said image carrier;

second driving means for causing said second developing member to rotate in a direction opposite to said one direction to supply the second developing agent onto said image carrier; and control means for selectively driving any one of said first and second driving means.

2. The device according to claim 1, which further comprises removal means for removing the first and second developing agents from at least the developing positions on the surfaces of said first and second developing members before development is started.

3. The device according to claim 1, wherein said first and second developing agents respectively comprise two-component developing agents each having a carrier and a nonmagnetic toner.

4. A developing device, opposing an image carrier which is rotated along one direction, for developing a latent image formed on said image carrier, comprising:

a first developing member, rotatably arranged to oppose said image carrier, for holding a first developing agent thereon, said first developing member comprising a first developing roller having a predetermined diameter;

a second developing member, rotatably arranged to oppose said image carrier and located adjacent to said first developing member along said one direction, for holding a second developing agent thereon, said second developing member comprising a second developing roller having a diameter larger than the predetermined diameter of the first developing roller, said first developing member being located at a downstream side of said second developing member with respect to said one direction;

first driving means for causing said first developing member to rotate in said one direction to supply the first developing agent onto said image carrier;

second driving means for causing said second developing member to rotate in a direction opposite to said one direction to supply the second developing agent onto said image carrier; and control means for selectively driving any one of said first and second driving means.

5. The device according to claim 4, wherein said removal means removes one of the first and second developing agents before the corresponding developing member is stopped after development is completed.

6. The device according to claim 5, wherein said removal means comprises a blade which is brought into contact with or separated from the surface of said second developing member, the second developing agent being scraped off by bringing said blade into contact with the surface of said second developing member.

7. The device according to claim 6, wherein said blade comprises an elastic member.

8. The device according to claim 5, wherein said first developing member comprises a magnet roll with a plurality of magnetic poles and a rotatable sleeve fitted around said magnet roll, and said removal means removes the first developing agent by rotating said rotatable sleeve in the direction opposite to said one direction.

9. The device according to claim 8, wherein said magnet roll has a maximum of five magnetic poles.

10. The device according to claim 4, which further comprises removal means for removing the first and second developing agents from at least the developing positions on the surfaces of said first and second developing members before development is started.

11. The device according to claim 4, wherein said first and second developing agents respectively comprise two-component developing agents each having a carrier and a nonmagnetic toner.

* * * * *